US009630158B2

(12) United States Patent
Inoue

(10) Patent No.: US 9,630,158 B2
(45) Date of Patent: Apr. 25, 2017

(54) METHOD OF DELIVERING PCR SOLUTION TO MICROFLUIDIC PCR CHAMBER

(75) Inventor: Hiroshi Inoue, Rockville, MD (US)

(73) Assignee: Canon U.S. Life Sciences, Inc., Rockville, MD (US)

( * ) Notice: Subject to any disclaimer, the term of this patent is extended or adjusted under 35 U.S.C. 154(b) by 362 days.

(21) Appl. No.: 13/263,464

(22) PCT Filed: Apr. 12, 2010

(86) PCT No.: PCT/US2010/030766

§ 371 (c)(1),
(2), (4) Date: Jan. 13, 2012

(87) PCT Pub. No.: WO2010/118430

PCT Pub. Date: Oct. 14, 2010

(65) Prior Publication Data

US 2012/0107822 A1 May 3, 2012

Related U.S. Application Data

(60) Provisional application No. 61/168,387, filed on Apr. 10, 2009.

(51) Int. Cl.

| | |
|---|---|
| ***B01F 13/00*** | (2006.01) |
| ***B01L 3/00*** | (2006.01) |
| ***B01L 7/00*** | (2006.01) |

(52) U.S. Cl.

CPC ..... *B01F 13/0093* (2013.01); *B01F 13/0071* (2013.01); *B01L 3/5027* (2013.01); *B01L 7/52* (2013.01); *B01L 2300/0816* (2013.01); *B01L 2300/0864* (2013.01); *B01L 2300/0867* (2013.01)

(58) Field of Classification Search

USPC ..... 435/6.12

See application file for complete search history.

(56) References Cited

U.S. PATENT DOCUMENTS

| | | | | |
|---|---|---|---|---|
| 6,681,788 | B2 * | 1/2004 | Parce et al. | 137/806 |
| 6,960,437 | B2 | 11/2005 | Enzelberger et al. | |
| 7,629,124 | B2 | 12/2009 | Hasson et al. | |
| 2005/0042639 | A1 | 2/2005 | Knapp et al. | |
| 2006/0257893 | A1 * | 11/2006 | Takahashi | B01L 3/502715 435/6.12 |

FOREIGN PATENT DOCUMENTS

| | | | | |
|---|---|---|---|---|
| WO | 2005/075683 A1 | | 8/2005 | |
| WO | WO2008005248 | * | 1/2008 | C12Q 1/68 |

OTHER PUBLICATIONS

Zhang C, Xing D, Li Y. Micropumps, microvalves, and micromixers within PCR microfluidic chips: Advances and trends. Biotechnol Adv. Sep.-Oct. 2007;25(5):483-514. Epub May 23, 2007. Review.*

Liu RH, Lodes MJ, Nguyen T, Siuda T, Slota M, Fuji HS, McShea A. Validation of a fully integrated microfluidic array device for influenza A subtype identification and sequencing. Anal Chem. Jun. 15, 2006;78(13):4184-93.*

Ieng Kin Lao, Yong Chee-Kien, Nichana Thepsuparungsikul, Micrototal Analysis Assembly for bacterial Total Nucleic Acid Analysis, Twelfth International Conference on Miniaturized Systems for Chemistry and Life Sciences, Oct. 12-16, 2008, p. 1728-1730.*

Kopp, et al., "Chemical Amplification: Continuous-Flow PCR on a Chip," Science, vol. 280, pp. 1046-1048 (1998).

Lagally, et al. "Single-Molecule DNA Amplification and Analysis in an Integrated Microfluidic Device," Analytical Chemistry, vol. 73, No. 3, pp. 565-570 (2001).

Park, et al., "Cylindrical Compact Thermal-Cycling Device for Continuous-Flow Polymerase Chain Reaction," Analytical Chemistry, vol. 75, No. 21, pp. 6029-6033 (2003).

* cited by examiner

*Primary Examiner* — Angela M Bertagna
*Assistant Examiner* — Olayinka Oyeyemi
(74) *Attorney, Agent, or Firm* — Rothwell, Figg, Ernst & Manbeck, P.C.

(57) ABSTRACT

The present invention relates to systems and methods of performing in-line mixing of assay components and delivery of such mixed components into microfluidic channels. In one aspect, a method of delivering mixed assay components is provided which comprises causing an unmixed primer solution to flow into a first mixing channel, the unmixed primer solution comprising a common reagent and a primer, holding the unmixed primer solution in the first mixing channel for at least a threshold amount of time to allow the unmixed primer solution to transition into a mixed primer solution, causing a buffer to flow into a second mixing channel, the buffer comprising the common reagent but not including a primer, and, after holding the unmixed primer solution in the first mixing channel for at least the threshold amount of time, drawing, from the first mixing channel, the mixed primer solution into a common exit channel.

31 Claims, 8 Drawing Sheets

METHOD OF DELIVERING PCR SOLUTION TO MICROFLUIDIC PCR CHAMBER

CROSS REFERENCE TO RELATED APPLICATIONS

This application is a 35 U.S.C. §371 National Phase Entry Application from PCT/US10/30766, filed Apr. 12, 2010, which claims the benefit of U.S. Provisional Patent Application No. 61/168,387, filed on Apr. 10, 2009, which is incorporated by reference herein in its entirety.

BACKGROUND

Field of the Invention

This invention relates to systems and methods for performing microfluidic assays. More specifically, the invention relates to systems and methods for allowing adequate mixing of desired materials within microfluidic channels.

Discussion of Related Art

The detection of nucleic acids is central to medicine, forensic science, industrial processing, crop and animal breeding, and many other fields. The ability to detect disease conditions (e.g., cancer), infectious organisms (e.g., HIV), genetic lineage, genetic markers, and the like, is ubiquitous technology for disease diagnosis and prognosis, marker assisted selection, correct identification of crime scene features, the ability to propagate industrial organisms and many other techniques. Determination of the integrity of a nucleic acid of interest can be relevant to the pathology of an infection or cancer. One of the most powerful and basic technologies to detect small quantities of nucleic acids is to replicate some or all of a nucleic acid sequence many times, and then analyze the amplification products. Polymerase chain reaction (PCR) is perhaps the most well-known of a number of different amplification techniques.

PCR is a powerful technique for amplifying short sections of deoxyribonucleic acid (DNA). With PCR, one can quickly produce millions of copies of DNA starting from a single template DNA molecule. PCR includes a three phase temperature cycle of denaturation of DNA into single strands, annealing of primers to the denatured strands, and extension of the primers by a thermostable DNA polymerase enzyme. This cycle is repeated so that there are enough copies to be detected and analyzed. In principle, each cycle of PCR could double the number of copies. In practice, the multiplication achieved after each cycle is always less than 2. Furthermore, as PCR cycling continues, the buildup of amplified DNA products eventually ceases as the concentrations of required reactants diminish. For general details concerning PCR, see Sambrook and Russell, *Molecular Cloning—A Laboratory Manual* (3rd Ed.), Vols. 1-3, Cold Spring Harbor Laboratory, Cold Spring Harbor, N.Y. (2000); *Current Protocols in Molecular Biology*, F. M. Ausubel et al., eds., Current Protocols, a joint venture between Greene Publishing Associates, Inc. and John Wiley & Sons, Inc., (supplemented through 2005) and *PCR Protocols A Guide to Methods and Applications*, M. A. Innis et al., eds., Academic Press Inc. San Diego, Calif. (1990).

Real-time PCR refers to a growing set of techniques in which one measures the buildup of amplified DNA products as the reaction progresses, typically once per PCR cycle. Monitoring the accumulation of products over time allows one to determine the efficiency of the reaction, as well as to estimate the initial concentration of DNA template molecules. For general details concerning real-time PCR see

*Real-Time PCR: An Essential Guide*, K. Edwards et al., eds., Horizon Bioscience, Norwich, U.K. (2004).

More recently, a number of high throughput approaches to performing PCR and other amplification reactions have been developed, e.g., involving amplification reactions in microfluidic devices, as well as methods for detecting and analyzing amplified nucleic acids in or on the devices. Microfluidic systems are systems that have at least one microfluidic channel (a.k.a., microchannel) through which a fluid may flow, which microfluidic channel has at least one internal cross-sectional dimension, (e.g., depth, width, length, diameter) that is typically less than about 1000 micrometers. Thermal cycling of the sample for amplification is usually accomplished in one of two methods. In the first method, the sample solution is loaded into the device and the temperature is cycled in time, much like a conventional PCR instrument. In the second method, the sample solution is pumped continuously through spatially varying temperature zones. See, for example, Lagally et al. (*Analytical Chemistry* 73:565-570 (2001)), Kopp et al. (*Science* 280:1046-1048 (1998)), Park et al. (*Analytical Chemistry* 75:6029-6033 (2003)), Hahn et al. (WO 2005/075683), Enzelberger et al. (U.S. Pat. No. 6,960,437) and Knapp et al. (U.S. Patent Application Publication No. 2005/0042639).

One challenge for continuous PCR in microchannels is effective mixing of the necessary components (i.e. reagents, samples, etc.) within the microchannels. Currently, mixing of components often occurs in wells on a microfluidic chip or occurs prior to being added to the chip. If mixing is attempted within the channels by, for example, drawing a flow of two laminar fluids into an adjacent channel, only the fluid directly in contact with the adjacent channel is drawn off; the second fluid continues its original flow path. Thus, it is desired to develop additional techniques to increase the ability to perform in-line mixing in continuous flow amplification reactions in microfluidic devices.

SUMMARY

The present invention relates to systems and methods of performing in-line mixing of assay components and delivery of such mixed components into microfluidic channels.

As used herein, the term "solution" means a liquid comprising two more substances, and the liquid need not be a homogeneous mixture of the two or more substances.

The invention herein is described using exemplary components of a reagent, primer, and a buffer solution. In one embodiment, the buffer solution may comprise a buffering agent. In another embodiment, the buffer solution may further comprise reagents. As used herein, the buffering solution does not include primers. However, the invention herein is not intended to be limited to such components, and the exemplary components are intended to be illustrative, and not limiting. In this respect, a broader reading of the invention is provided via the following: throughout the specification, "reagent" can be read as "Liquid A" or "first fluid", "primer" can be read as "Liquid B" or "second fluid", and "buffer" can be read as "Liquid A" or "first fluid" alone or alternatively, as a separate "Liquid C" or "third fluid".

It is also within the scope of the present invention that more than 2 or 3 fluids can be utilized, as can more than the number of mixing channels shown herein. As stated above, the description herein is intended to exemplify the present invention which allows for an improved system and method to mix fluids in a microfluidic environment while utilizing the shortening the length of microfluidic channel necessary for such mixing.

In one aspect, the invention provides a method of mixing components. In some embodiments, the method includes: causing a reagent and a primer to flow into a first mixing channel, which may be a microfluidic channel; holding the reagent and the primer in the first mixing channel for at least a threshold amount of time (e.g., an amount of time that is a function of the amount of time it takes for the reagent and the primer to mix by diffusion) so as to allow the reagent and the primer to mix; causing a buffer to flow into a second mixing channel, which may also be a microfluidic channel; after holding the reagent and the primer in the first mixing channel for at least the threshold amount of time, thereby creating a reagent/primer mixture, drawing, from the first mixing channel, the reagent/primer mixture into a common exit channel, which may also be a microfluidic channel; and after drawing the reagent/primer mixture into the exit channel, drawing, from the second mixing channel, the buffer into the common exit channel. In some embodiments, the threshold amount of time is greater than about 10 seconds.

In some embodiments, the microfluidic channels are formed on a mixing chip. In these embodiments, the method may also include configuring the mixing chip such that the common exit channel is in fluid communication with an input well of an interface chip. The interface chip may be configured such that the input well is in fluid communication with a plurality of DNA sample wells. The method may also include connecting the interface chip with a PCR chip such that the DNA sample and input well of the interface chip are in fluid communication with an input well of the PCR chip.

In some embodiments, the step of drawing the buffer into the common exit channel occurs substantially immediately after substantially all of the reagent/primer mixture exits the first mixing channel. The method may also include: causing a buffer to flow into the first mixing channel after at least a portion of the reagent/primer mixture has been drawn out of the first mixing channel and into the common exit channel, the buffer which may comprise the reagent but not including a primer.

In some embodiments, the method may also include: holding the buffer in the second mixing channel while holding at least some of the reagent/primer mixture in the first mixing channel; causing the reagent and a second primer to flow into a third mixing channel while holding at least a portion of the buffer in the second mixing channel; holding the reagent and the second primer in the third mixing channel for at least a second threshold amount of time so as to allow the reagent and the second primer to mix, thereby forming a second reagent/primer mixture; and drawing, from the third mixing channel, the second reagent/primer mixture into the common exit channel after drawing, from the second mixing channel, the buffer into the exit channel. The step of drawing the second reagent/primer mixture into the common exit channel may occur substantially immediately after substantially all of the buffer exits the second mixing channel. Also, the first threshold amount of time and the second threshold amount may be the same amount of time or they may be different amounts of time.

In another aspect, the invention provides a system for analyzing DNA. In some embodiments, the system includes an apparatus for mixing a primer with a reagent. In some embodiments, this mixing apparatus includes: a reagent container; a primer container; an input channel in fluid communication with the reagent container and the primer container; a first mixing channel in fluid communication with the input channel; a second mixing channel in fluid communication with the input channel; and a controller.

In some embodiments, the controller is configured such that the controller is operable to put the apparatus in a state in which a reagent and primer is held in the first mixing channel for a threshold amount of time so as to allow the reagent and the primer to mix, thereby forming a reagent/primer mixture, and a buffer is held in the second mixing channel. The controller may be further configured such that the controller (i) causes the reagent/primer mixture to be drawn out of the first mixing channel and into a common exit channel after the reagent and the primer has been held in the first mixing channel for at least the threshold amount of time, and (ii) causes the buffer to be drawn out of the second mixing channel and into the common exit channel after drawing the reagent/primer mixture into the exit channel.

In other embodiments, the controller is configured such that the controller is operable to put the apparatus in a state in which a reagent and a first primer is held in the first mixing channel, a buffer is held in the second mixing channel, and the reagent and a second primer is held in the third mixing channel, and the controller is operable to (i) cause the reagent and the first primer to be drawn out of the first mixing channel and into a common exit channel after the reagent and the first primer have been held in the first mixing channel for at least a threshold amount of time; (ii) cause the buffer to be drawn out of the second mixing channel and into the common exit channel after drawing the reagent and first primer into the exit channel and (iii) cause the reagent and the second primer to be drawn out of the third mixing channel and into the common exit channel after drawing the buffer into the exit channel.

In further embodiments, in the systems and methods of performing in-line mixing of assay components and delivery of such mixed components into microfluidic channels described herein, the order in which the reagent and primer or the buffer are added to the mixing channels can alternate, such that if a reagent and primer is added to the first mixing channel, and a buffer is added to the second mixing channel, and so forth, after the reagent and primer mixture is removed from the first mixing channel, the first mixing channel will then be filled with buffer, and after the buffer is removed from the second mixing channel, the second mixing channel will then be filled with reagent and primer, etc. In this manner, during successive fillings of the mixing channels, the type of fluid contained in the mixing channel will alternate with each filling. Accordingly, it is within the scope of this invention that any description of a reagent and primer being added to a first mixing channel can instead relate to a reagent and primer being added to a second mixing channel and so forth for those instances where a buffer has instead been added to the first mixing channel.

The above and other aspects and embodiments are described below with reference to the accompanying drawings.

DETAILED DESCRIPTION OF THE EXEMPLARY EMBODIMENTS

Solutions for use in PCR include components such as, for example, polymerase, primers, dNTPS and DNA sample. Before starting to run PCR in a microfluidic chamber, thorough mixing of these components in particular ratios is required, followed by the delivery of a particular volume of the mixture to the PCR chamber (e.g., microchannel). A challenge known in the art is the difficulty associated with in-line mixing of PCR components in the desired ratios followed by the delivery of a particular volume to a microfluidic PCR chamber, such as a microchannel. Reagents, primers and buffers useful in performing PCR amplifications are well known to the skilled artisan or as described herein.

Figure 1:
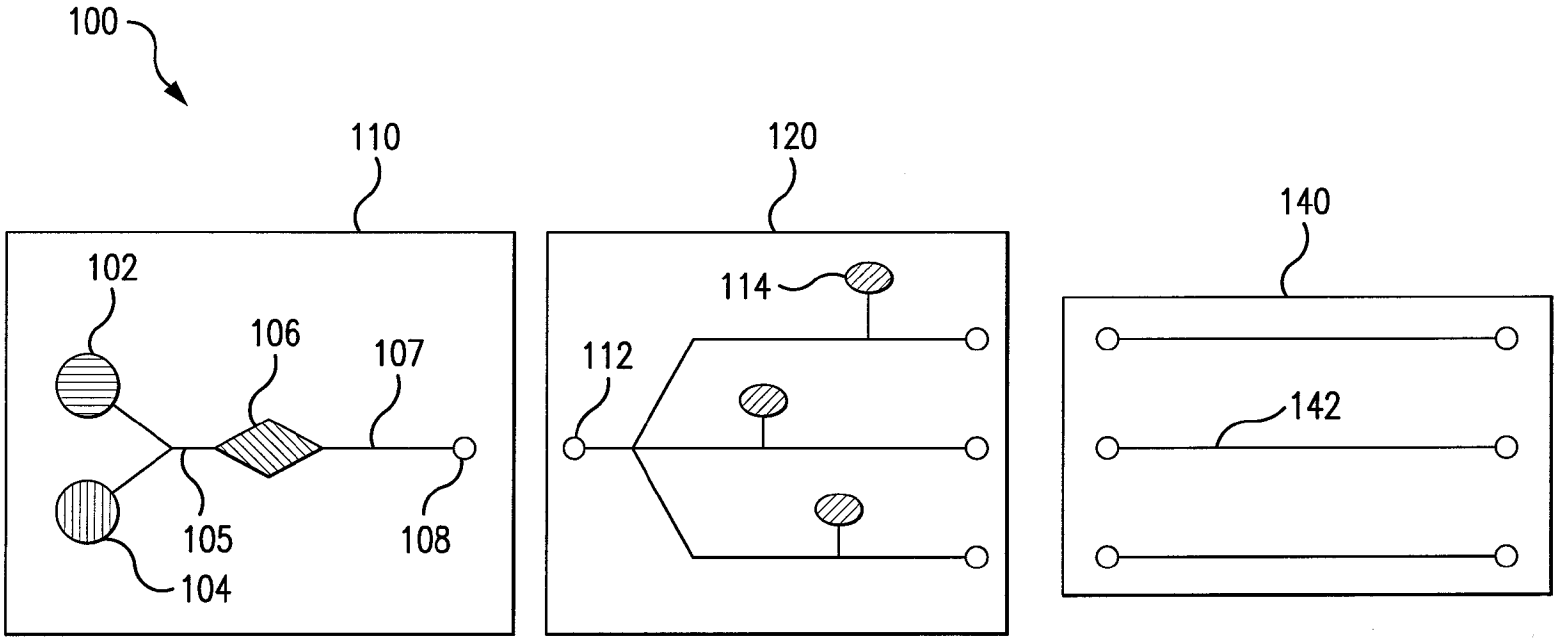
FIG. 1 is a schematic depicting a system for analyzing DNA according to an embodiment of the invention.

FIG. 1 illustrates a PCR system 100 according to one example embodiment of the invention. As shown in FIG. 1, PCR system 100 may include a mixing chip 110, an interface chip 120, and a PCR microfluidic chip 140. Reagents and primers may be mixed in the mixing chip 110 at the desired ratio and may be delivered to the interface chip 120, via ports 108 and 112, where the solution is further mixed with DNA sample 114. The DNA-containing PCR solution may then be delivered to PCR microfluidic chip 140 that includes one or more microchannels 142 in which amplification will take place via the PCR technique. The microfluidic PCR chip 140 may, for example, operate as described in connection with commonly owned U.S. Pat. No. 7,629,124, incorporated herein by reference.

While FIG. 1 illustrates a three chip system, the invention is not so limited. In fact, a system according to an embodiment of the invention could have a single chip, two chips, or any number of chips. For example, in some embodiments (see FIG. 8), components of chips 110, 120 and 140 could all be formed on a single chip.

In some embodiments, a function of mixing chip 110 is to proportionally mix primers 104 and other reagents 102 common to the desired assay. The common reagents 102 and primers 104 are drawn into a mixing region 106 via channel 105 and then held there for an amount of time, after which, the resulting mixture (a.k.a., "reagent/primer mixture"), which may or may not be homogeneous, is drawn into an exit channel 107 connected to exit port 108. There are several ways in which reagents 102 and primers 104 may be drawn into mixing region 106. For example, in one embodiment, the primer 104 and reagent 102 may be drawn into the mixing channel laminarly (i.e., the primer 104 and reagent 102 may be side by side as they are drawn into the channel). In another embodiment, an amount of primer 104 may be drawn into the channel first, followed by an amount of reagent 102 (or vice versa), followed by another amount of primer 104, etc.

Without external disruption, the mixing of the primer 104 and reagent 102 within mixing region 106 is controlled by diffusion. Therefore, to ensure that adequate mixing takes place in mixing region 106, the primer 104 and reagent 102 should be held in mixing region 106 for some particular, threshold amount of time. In some embodiments, the threshold amount of time can be a function of the amount of time it takes for the reagent 102 and the primer 104 to mix by diffusion. Thus, the threshold amount of time will be influenced by the amount of the fluids that are to be mixed, and by the size of the mixing region in which they are contained. In some embodiments, the threshold time may be at least 10 seconds, although it is envisioned that certain systems may require a longer or shorter threshold time.

Figure 2:
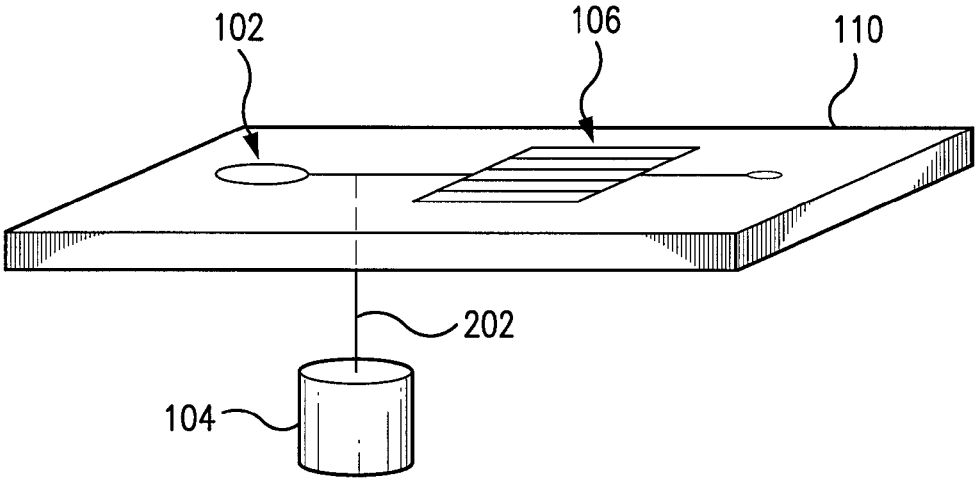
FIG. 2 is a schematic of a mixing chip according to an embodiment of the invention.

Further aspects of mixing chip 110 are illustrated in FIG. 2. More specifically, FIG. 2 illustrates mixing region 106 according to an embodiment which includes a plurality of mixing channels. In the embodiment of mixing region 106 illustrated in FIG. 2, a sipper 202 is illustrated which can be used to introduce a primer 104 into mixing region 106. Of course, primer 104 can be introduced into mixing region other ways, such as, for example, from a well located on the mixing chip as illustrated in FIG. 1.

Figure 3:
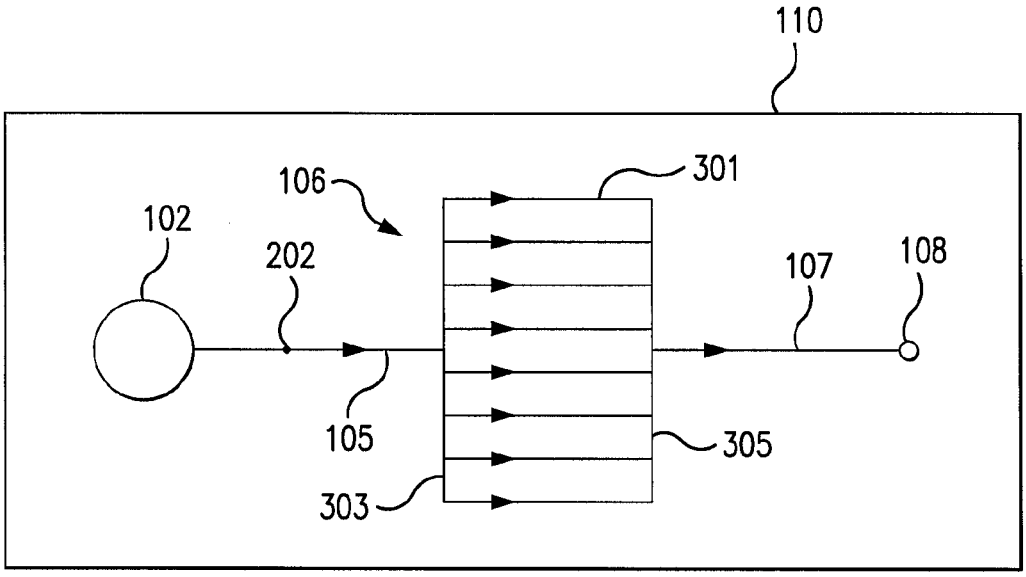
FIG. 3 is a top-view of the mixing chip shown in FIG. 2.
Figure 4:
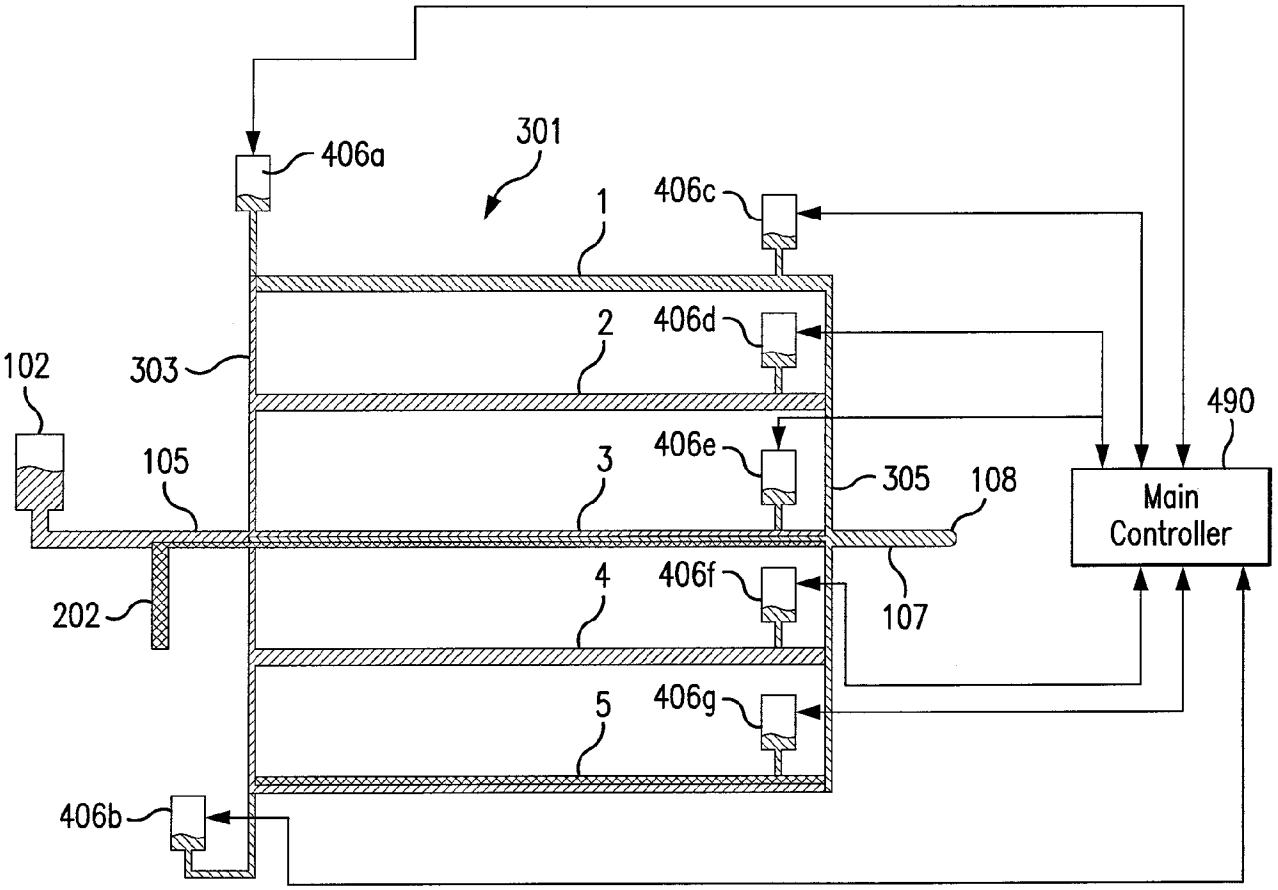
FIG. 4 further illustrates a mixing chip according to some embodiments of the invention.

Referring now to FIG. 3, a top view of the mixing chip 110 embodiment of FIG. 2 is shown. More specifically, FIG. 3 illustrates that mixing region 106, in some embodiments, may include a set of generally parallel mixing channels 301. One end of each channel in set 301 is connected to channel 105 via a transverse channel 303 and the other end of each channel in set 301 is connected to exit channel 107 via a transverse channel 305. To further illustrate the embodiment of the invention shown in FIG. 3, FIG. 4 provides a more detailed schematic of the mixing region 106 according to the embodiment.

As discussed above, to ensure that adequate mixing takes place in mixing region 106, the primer 104 and reagent 102 should be held in mixing region 106 for some particular amount of time. To decrease the length of this time, the present invention provides an approach whereby, one at a time, each mixing channel 301 is filled (fully or partially) with an "unmixed primer solution" (e.g., a solution containing primer 104 and reagent 102) or a buffer (e.g., common reagent 102 and no primer 104) and then, at some later point in time (e.g., several seconds to minutes later), on a first-in-first out (FIFO) basis, the solution in each mixing channel is drawn out of the mixing channel and into to the common exit channel 107, where the solution will flow to exit port 108 so that it can be introduced, for example, into interface chip 120. As also discussed above, there are several ways in which an unmixed primer solution may flow into a mixing channel. For example, in one embodiment, the unmixed primer solution may flow into a mixing channel by drawing the primer 104 and reagent 102 into the mixing channel laminarly (i.e., by drawing the primer 104 and reagent 102 into the mixing channel such that the primer 104 and reagent 102 flow substantially side by side into the channel). In another embodiment, the unmixed primer solution may flow into a mixing channel by first drawing an amount of primer 104 into the channel followed by drawing into the channel an amount of reagent 102 (or vice versa).

In one embodiment of this system, each of the mixing channels may be coupled to one or more independent pressure controllers (e.g., vacuum pressure controllers or other pressure controllers) in order to start and stop the flow of fluid into and out of each of the channels. For example, as shown in FIG. 4, a plurality of pressure controllers 406 may be employed.

As a specific, non-limiting example, chip 110 may be operated such that a first unmixed primer solution flows into mixing channel 1 (see FIG. 4) over a period of time, such as, for example, in a time of 100 seconds. The first unmixed primer solution is then held there for at least a threshold amount of time, which may be at least 10 seconds, preferably more than about 20 seconds, preferably more than about 30 seconds, preferably more than about 40 seconds, preferably more than about 50 seconds, preferably more than about 60 seconds, preferably more than about 70 seconds, preferably more than about 80 seconds, preferably more than about 90 seconds and more preferably more than about 100 seconds. Next, a buffer (e.g., a solution consisting only of the reagents 102) flows into mixing channel 2 and is held there for at least a threshold amount of time. Next, a second unmixed primer solution flows into mixing channel 3 and is held there for at least a threshold amount of time. Next, the buffer flows into mixing channel 4 and is held there for at least a threshold amount of time. Next, a third unmixed primer solution flows into mixing channel 5 and is held there for at least a threshold amount of time.

After the first unmixed primer solution has been held in mixing channel 1 for at least the threshold amount of time, the first solution, which at this point should be a reagent/primer mixture, may be drawn out of channel 1 and into exit channel 107, from which the reagent/primer mixture will flow, for example, to the next chip (e.g., interface chip 120) via exit port 108 or to another area of the mixing chip 110 where further mixing and/or assays will occur.

Next, the buffer in channel 2 is drawn out of channel 2 and into exit channel 107. Next, after the second unmixed primer has been held in mixing channel 3 for at least the threshold amount of time, the second solution, which at this point should be a reagent/primer mixture, may be drawn out of channel 3 and into exit channel 107. Next, the buffer in channel 4 is drawn out of channel 4 and into exit channel 107. Next, after the third unmixed primer solution has been held in mixing channel 5 for at least the threshold amount of time, the third solution, which at this point should be a reagent/primer mixture, may be drawn out of channel 5 and into exit channel 107.

On the next cycle, it is preferred that each mixing channel that held a primer solution (i.e., a solution comprising the reagent and a primer) in the last cycle should hold a buffer and vice versa (but this is not a requirement). That is, sequentially, all of the primer solutions originally held in the mixing channels will be replaced by a buffer, and all of the buffers originally held in the mixing channels will be replaced by a primer solution, thereby reducing or eliminating contamination and ensuring that each of the primer solutions are separated by plugs of buffer as they travel throughout the remaining channels.

Accordingly, in the next cycle, mixing chip 110 may be operated such that, first, the buffer is forced into mixing channel 1. Next, the first unmixed primer solution is forced into mixing channel 2 and is held there for at least the threshold amount of time. Next, the buffer is forced into mixing channel 3. Next, the second unmixed primer solution flows into mixing channel 4 and is held there for at least a threshold amount of time. Next, the buffer is forced into mixing channel 5. After the first unmixed primer solution has been held in mixing channel 2 for at least the threshold amount of time, thereby becoming a reagent/primer mixture, the buffer in mixing channel 1 is drawn out of channel 1 and into exit channel 107. Next, the first reagent/primer mixture may be drawn out of channel 2 and into exit channel 107. Next, the buffer in channel 3 is drawn out of channel 3 and into exit channel 107. Next, after the second unmixed primer solution has been held in mixing channel 4 for at least the threshold amount of time, thereby becoming a reagent/primer mixture, the second reagent/primer mixture may be drawn out of channel 4 and into exit channel 107. Next, the buffer in channel 5 is drawn out of channel 5 and into exit channel 107. While FIG. 4 illustrates 5 mixing channels 301, it is understood that more mixing channels or fewer mixing channels may be used.

Figure 5:
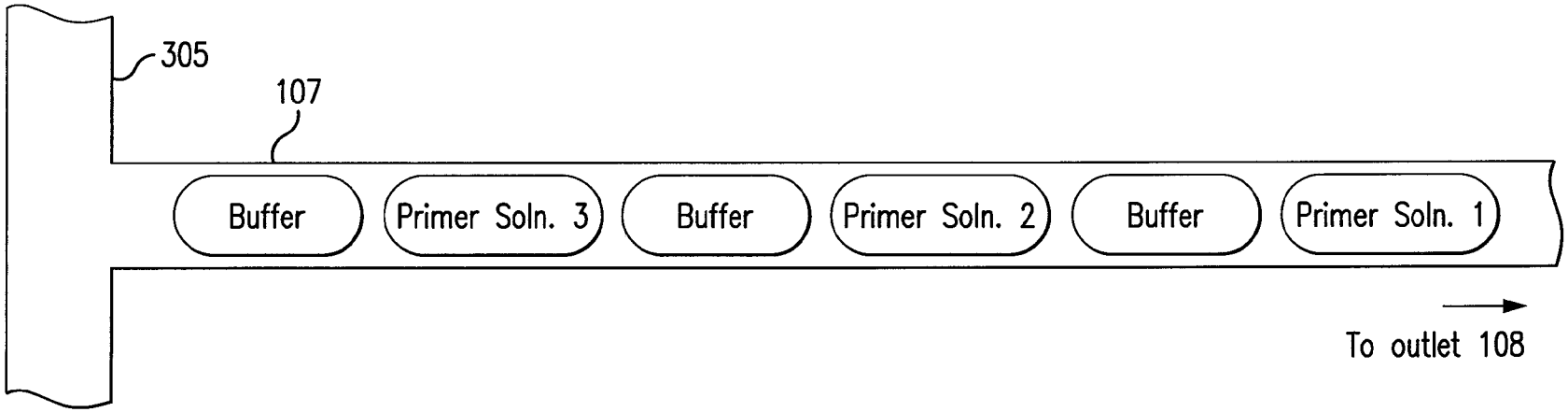
FIG. 5 illustrates the solution flow in a channel in accordance with an embodiment utilizing a first-in-first-out mixing function.
Figure 6:
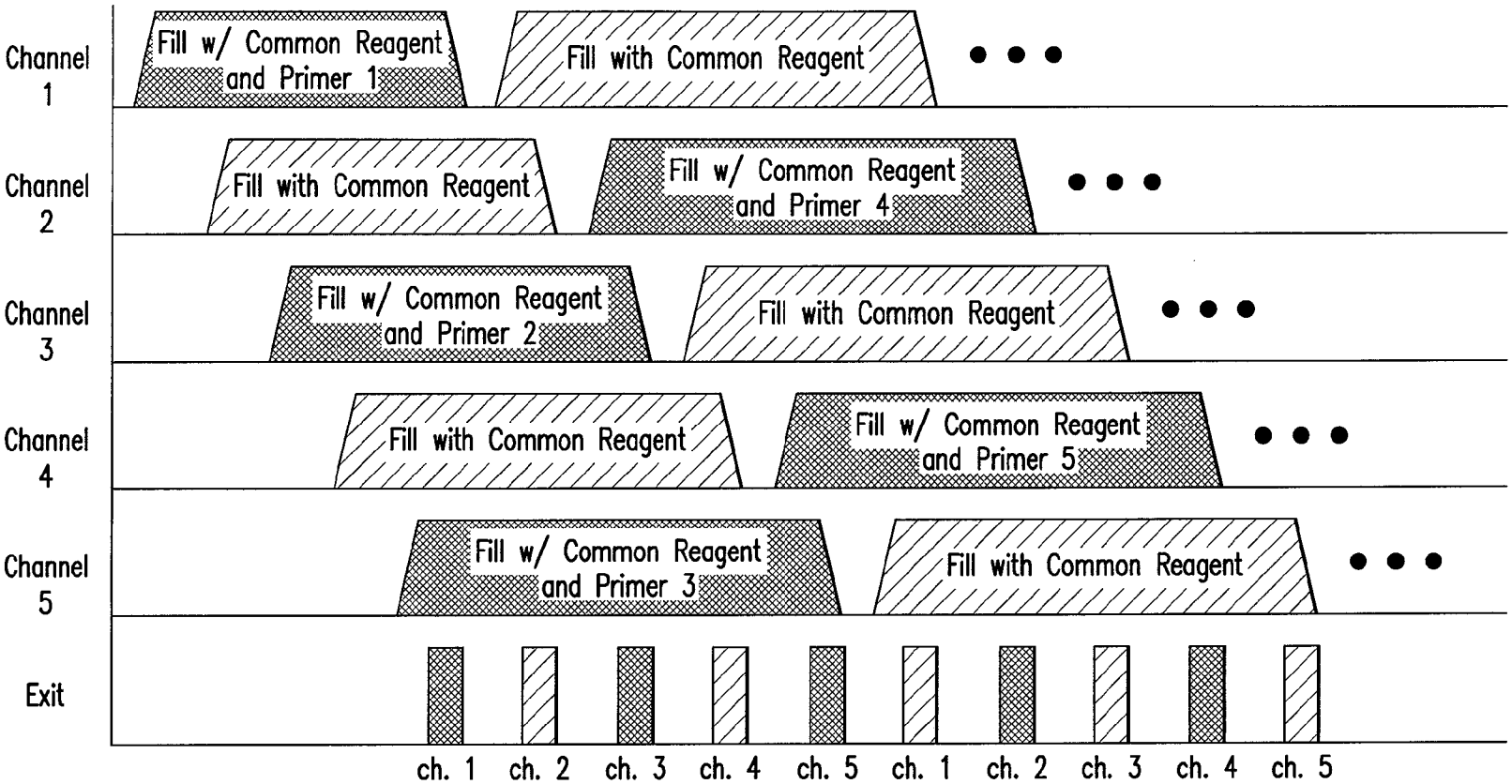
FIG. 6 is a schematic showing the timing of a first-in-first-out mixing function in accordance with an embodiment of the invention.

The above described process will produce a solution flow as shown in FIG. 5, in accordance with one embodiment of the invention. As will be noted, each primer solution is separated from another primer solution by the buffer. As stated, in one embodiment, the movement of solutions into and out of the channels is governed by the first-in-first-out rule. This is depicted in FIG. 5 which illustrates a solution flow comprising a first primer solution, followed by a buffer, followed by a second primer solution, followed by a buffer, followed by a third primer solution. FIG. 6 illustrates a timing diagram which can be used to govern the flow of fluids into and out of the mixing region 106 in accordance with an embodiment of the invention which utilizes the first-in-first-out rule. It should be noted that the buffer could be introduced before the primer so that the fluid flow would be offset from what is depicted in FIGS. 5 and 6.

As discussed above, each of the mixing channels may be coupled to one or more independent pressure controllers 406*c-g* in order to start and stop the flow of fluid into and out of each of the channels. Additionally, as shown in FIG. 4, the pressure controllers 406*a-g* may be in communication with a main controller 490 (e.g., a general or special purpose computer or other controller), which is configured to control the pressure controllers 406*a-g* to achieve the desired fluid flow, including the above-described first-in-first-out movement of the solutions.

In some embodiments, to fill and to empty the channels 301 in the FIFO manner described above, main controller 490 controls the pressure controllers 406*a-g* as follows. First, to fill channels 1, 2 or 3, pressure controller 406*a* is configured to create a negative pressure, which will cause the fluid to flow up transverse channel 303 in the direction of controller 406*a*. When the fluid reaches the junction of transverse channel 303 and the mixing channel into which the fluid is desired to flow, pressure controller 406*a* may be configured to cease creating the negative pressure. At the same time, main controller 490 may control one or more pressure controllers (e.g. pressure controllers 406*c-e*) such that the pressure at the end of the desired mixing channel that is connected to channel 303 is higher than the pressure at the other end of the mixing channel, thus creating a pressure differential. This pressure differential should cause the fluid to flow into the desired channel from the transverse channel 303. When the mixing channel is filled as desired, controller 490 may control the system such that the pressure at the end of the mixing channel that is connected to transverse channel 303 (e.g. the end of mixing channel 2 connected transverse channel 303) is equal to the pressure at the other end of the mixing channel (e.g. the other end of mixing channel 2 connected transverse channel 305).

Similarly, to fill channels 4 or 5, pressure controller 406*b* is configured to create a negative pressure, which will cause the fluid to flow down transverse channel 303 in the direction of controller 406*b*. When the fluid reaches the junction of transverse channel 303 and the mixing channel into which the fluid is desired to flow, pressure controller 406*b* may be configured to cease creating the negative pressure. At the same time, main controller 490 may control one or more pressure controllers (e.g. pressure controllers 406*f-g*) such that the pressure at the end of the desired mixing channel that is connected to channel 303 is higher than the pressure at the other end of the mixing channel, thus creating a pressure differential. This pressure differential should cause the fluid to flow into the desired mixing channel from the transverse channel 303.

As discussed above, to hold a solution in a particular mixing channel, main controller 490 need only control pressure controllers 406 such that the pressure at one of the channels equals the pressure at the other end.

In some embodiments, to draw a fluid out of a channel and into exit channel 107, main controller 490 adjusts one or more pressure controllers 406 such that (i) the pressure at the left end of a channel (i.e., the end connected to transverse channel 303) is greater than the pressure at the other end of a channel (i.e., the end connected to transverse channel 305), and (ii) the pressure at the end of a channel that is connected to transverse channel 305 is greater than the pressure at outlet port 108. For example, to draw a fluid out of channel 2 and into exit channel 107, main controller 490 adjusts pressure controller 406*d* such that (i) the pressure at the left end of channel 2 (i.e., the end connected to transverse channel 303) is greater than the pressure at the other end of channel 2 (i.e., the end connected to transverse channel 305), and (ii) the pressure at the end of channel 2 that is connected to transverse channel 305 is greater than the pressure at outlet port 108. At the same time, to keep the fluids in the other channels from being drawn out of those channels, main controller 490 controls the system such that, for each channel, the pressure at one end of the channel equals the pressure at the other end.

Figure 7A:
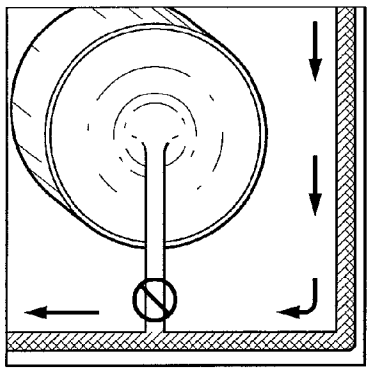
FIGS. 7A-7E illustrate the mixing of two laminar fluids flowing through the same channel.
Figure 7B:
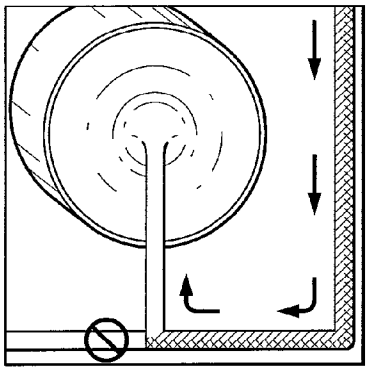
Figure 7C:
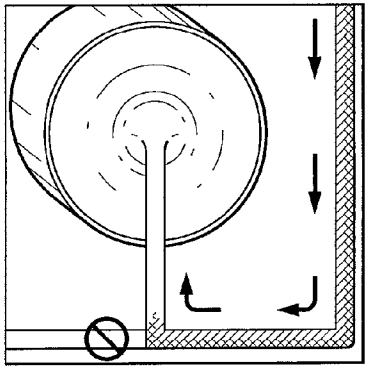
Figure 7D:
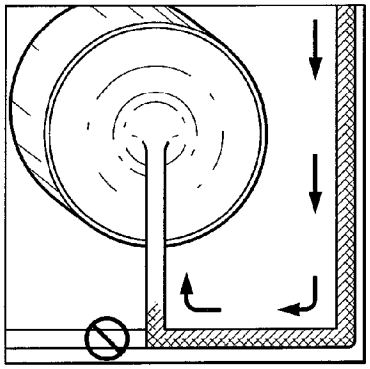
Figure 7E:
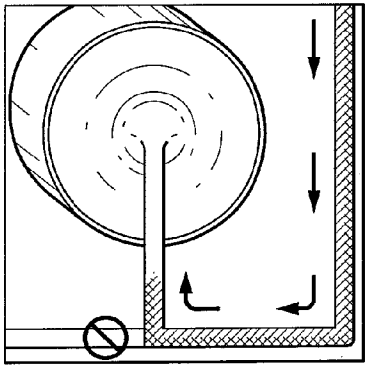

As discussed above, the unmixed primer solution to be introduced into a mixing channel may initially be subject to laminar flow. In order to ensure that both the reagent 102 and primer 104 are drawn into the same mixing channel in the necessary amounts, in accordance with one embodiment, the flow of fluid in the transverse channel 303 is stopped prior to drawing off the fluid into a mixing channel. In accordance with this embodiment, both the reagent 102 and primer 104 are allowed to be drawn off together. This is depicted in FIG. 7A, wherein the initial fluid flow of the reagent and primer fluids is illustrated by the arrows and is caused by a first pump that is situated to the bottom left of the fluid flow (not shown). In FIG. 7B, the first pump has been stopped such that the fluid is no longer flowing to the left. Rather, a second pump that controls fluid flow up the channel in the center of the picture has been activated, such that both fluids are drawn together into the center channel. FIGS. 7C-7E further illustrate that both of the laminar fluids are drawn into the center channel. As shown, the laminar fluids flow increasingly further into the center channel in FIGS. 7B-7E, respectively. It is envisioned that similar methods can be utilized in the present application in order to direct the flow of multiple laminar fluids into the mixing channels. As will be evident to one of skill in the art, any method of controlling fluid flow known in the art can be utilized, including a system that uses valves.

Figure 8:
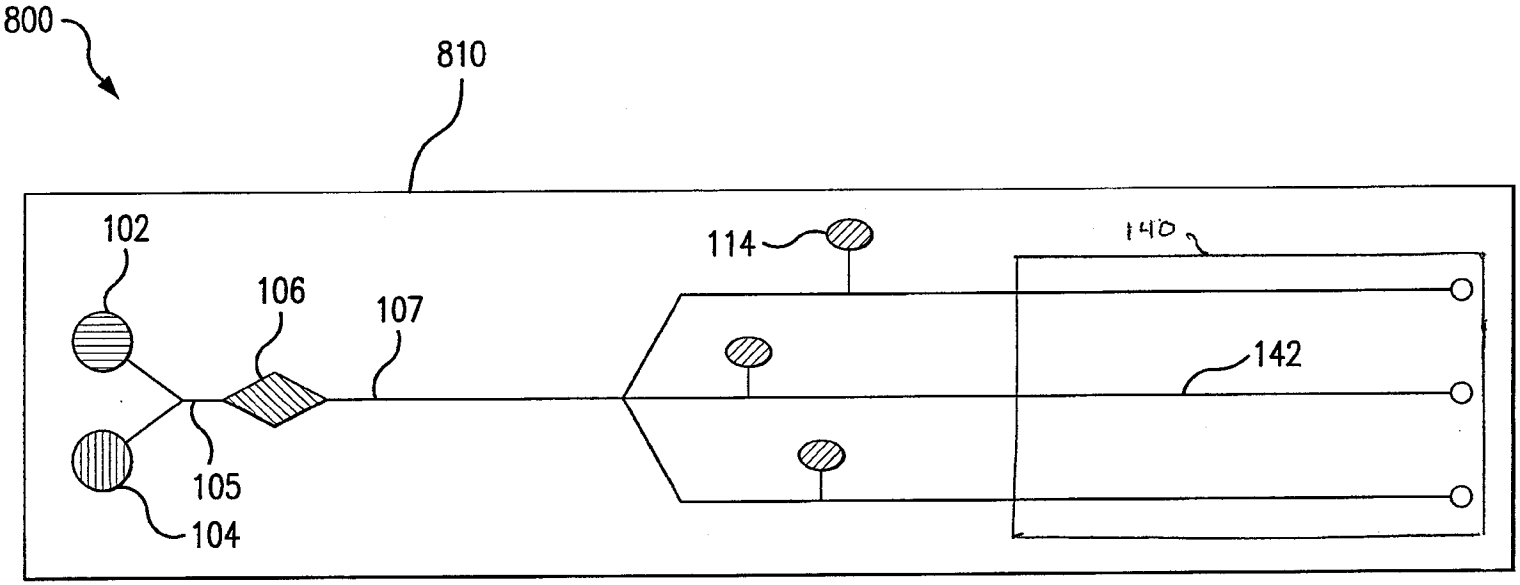
FIG. 8 is a schematic depicting a system for analyzing DNA according to another embodiment of the invention.

As will also be apparent, while the present invention has been described herein as being used in a multi-chip format, the methods and systems for in-line mixing can be utilized anywhere mixing within a channel is desired, including wherein all mixing, assays, and analysis occur on a single microfluidic chip (see, e.g. FIG. 8).

While various embodiments of the present invention have been described above, it should be understood that they have been presented by way of example only, and not limitation. Thus, the breadth and scope of the present invention should not be limited by any of the above-described exemplary embodiments. Additionally, while the processes described above are shown as a sequence of steps, this was done solely for the sake of illustration. Accordingly, it is contemplated that some steps may be added, some steps may be omitted, and the order of the steps may be re-arranged.

The invention claimed is:

1. A method of delivering a solution flow, comprising:

causing a reagent and a primer to flow into a first mixing channel;

stopping the reagent and the primer in the first mixing channel by keeping both ends of the first mixing channel at the same pressure for at least a threshold amount of time so as to allow the reagent and the primer to mix, thereby forming a reagent/primer mixture;

causing a buffer to flow into a second mixing channel, the first and second mixing channels being located on a mixing chip, wherein the mixing chip is separate and in fluid communication with a PCR chip through an interface chip, wherein the PCR chip is configured for performing an amplification reaction;

after holding the reagent and the primer in the first mixing channel for at least the threshold amount of time, drawing, from the first mixing channel, the reagent/primer mixture into a common exit channel located on the mixing chip; and adding DNA samples to the reagent/primer mixture while the reagent/primer mixture is in the interface chip.

2. The method of claim 1, wherein the threshold amount of time is the amount of time it takes for the reagent and the primer to mix by diffusion.

3. The method of claim 1, wherein the threshold amount of time is greater than 10 seconds.

4. The method of claim 1, wherein the first and second mixing channels are microfluidic channels and the common exit channel is a microfluidic channel.

5. The method of claim 4, wherein the microfluidic channels are formed on the mixing chip.

6. The method of claim 5, further comprising: configuring the mixing chip such that the common exit channel is in fluid communication with an input well of the interface chip.

7. The method of claim 6, wherein the interface chip is configured such that the input well located on the interface chip is in fluid communication with a plurality of DNA sample wells located on the interface chip.

8. The method of claim 7, further comprising connecting the interface chip with the PCR chip such that each of the plurality of the DNA sample wells located on the interface chip and input well of the interface chip are in fluid communication with an input well of the PCR chip.

9. The method of claim 1, further comprising: causing a buffer to flow into the first mixing channel after a least a portion of the reagent/primer mixture has been drawn out of the first mixing channel and into the common exit channel, the buffer comprising the reagent but not including a primer.

10. The method of claim 1, further comprising:

while holding at least a portion of the reagent and the primer in the first mixing channel, holding the buffer in the second mixing channel;

while holding at least a portion of the buffer in the second mixing channel, causing a reagent and a second primer to flow into a third mixing channel;

holding the reagent and the second primer in the third mixing channel for at least a second threshold amount of time so as to allow the reagent and the second primer to mix, thereby forming a second reagent/primer mixture;

after drawing the reagent/primer mixture into the common exit channel, drawing, from the second mixing channel, the buffer into the common exit channel; and after drawing, from the second mixing channel, the buffer into the common exit channel, drawing, from the third mixing channel, the second reagent/primer mixture into the common exit channel;

wherein the buffer separates the first reagent/primer mixture from the second reagent/primer mixture within the common exit channel.

11. The method of claim 10, wherein the step of drawing the buffer into the common exit channel occurs substantially immediately after substantially all of the reagent/primer mixture exits the first mixing channel.

12. The method of claim 10, wherein the step of drawing the second reagent/primer mixture into the common exit channel occurs substantially immediately after substantially all of the buffer exits the second mixing channel.

13. The method of claim 10, wherein the first threshold amount of time and the second threshold amount are the same amount of time.

14. The method of claim 10, wherein the first threshold amount of time and the second threshold amount are different amounts of time.

15. A system for analyzing DNA, comprising:

an apparatus for mixing a primer with a reagent, comprising:

a reagent container;

a primer container;

an input channel in fluid communication with the reagent container and the primer container;

a first mixing channel in fluid communication with the input channel;

a second mixing channel in fluid communication with the input channel, the first and second mixing channels being located on a mixing chip, wherein the mixing chip is separate and in fluid communication with a PCR chip through an interface chip, wherein the PCR chip is configured for performing an amplification reaction; and a controller, wherein the controller is configured such that the controller is operable to put the apparatus in a state in which a reagent and primer are stopped in the first mixing channel by keeping both ends of the first mixing channel at the same pressure for a threshold amount of time so as to allow the reagent and the primer to mix, thereby forming a reagent/primer mixture, and a buffer is held in the second mixing channel, and the controller is further configured such that the controller (i) causes the reagent/primer mixture to be drawn out of the first mixing channel and into a common exit channel located on the mixing chip after the reagent and the primer has been held in the first mixing channel for at least a threshold amount of time, and (ii) causes DNA samples to be added to the reagent/primer mixture while the reagent/primer mixture is in the interface chip.

16. The system of claim 15, wherein the threshold amount of time is the amount of time it takes for the reagent and the primer to mix by diffusion.

17. The system of claim 15, wherein the threshold amount of time is greater than about 10 seconds.

18. The system of claim 15, wherein the first and second mixing channels are microfluidic channels and the common exit channel is a microfluidic channel.

19. The system of claim 18, wherein the microfluidic channels are formed on the mixing chip.

20. The system of claim 19, wherein the mixing chip is configured such that the common exit channel is in fluid communication with an input well of the interface chip.

21. The system of claim 20, wherein the interface chip is configured such that the input well located on the interface chip is in fluid communication with a plurality of DNA sample wells located on the interface chip.

22. The system of claim 21, wherein the interface chip is connected to the PCR chip such that each of the plurality of DNA sample wells located on the interface chip and input well of the interface chip are in fluid communication with an input well of the PCR chip.

23. The system of claim 15, wherein the controller is further configured such that the controller causes a buffer to enter the first mixing channel after the reagent/primer mixture exits the first mixing channel and before any other primer enters the first mixing channel.

24. The system of claim 15, wherein the apparatus further comprises a third mixing channel.

25. The system of claim 15, wherein the common exit channel is in fluid communication with one or more DNA sample wells of the interface chip, said DNA sample wells are in fluid communication with a microfluidic channel of the PCR chip, and a single microfluidic chip comprises the mixing chip, the interface chip and the PCR chip.

26. A system of for analyzing DNA, comprising:

an apparatus for mixing a primer with a reagent, comprising:

a reagent container;

a primer container;

an input channel in fluid communication with the reagent container and the primer container;

a first mixing channel in fluid communication with the input channel;

a second mixing channel in fluid communication with the input channel;

a third mixing channel in fluid communication with the input channel, the first, second and third mixing channels being located on a mixing chip, wherein the mixing chip is separate and in fluid communication with a PCR chip through an interface chip, wherein the PCR chip is configured for performing an amplification reaction; and a controller, wherein the controller is configured such that the controller is operable to put the apparatus in a state in which a reagent and a first primer are held in the first mixing channel by keeping both ends of the first mixing channel at the same pressure for a threshold amount of time so as to allow the reagent and the first primer to mix, thereby forming a first reagent/primer mixture, a buffer is held in the second mixing channel, and a reagent and a second primer are held in the third mixing channel and form a second reagent/primer mixture, and the controller is further configured such that the controller (i) causes the first reagent/primer mixture to be drawn out of the first mixing channel and into the common exit channel after the reagent and the first primer have been held in the first mixing channel for at least the threshold amount of time; (ii) causes the buffer to be drawn out of the second mixing channel and into the common exit channel after drawing the first reagent/primer mixture into the common exit channel; (iii) causes the second reagent/primer mixture to be drawn out of the third mixing channel and into the common exit channel after drawing the buffer into the common exit channel and (iv) causes DNA samples to be added to the first reagent/primer mixture while the first reagent/primer mixture is in the interface chip;

wherein the buffer separates the first reagent/primer mixture from the second reagent/primer mixture within the common exit channel.

27. The system of claim 26, wherein the controller is further configured such that the controller (i) causes a buffer to enter the first mixing channel after the first reagent/primer mixture exits the first mixing channel and before any other primer enters the first mixing channel, and (ii) causes a buffer to enter the third mixing channel after the second reagent/primer mixture exits the third mixing channel and before any other primer enters the third mixing channel.

28. A method of delivering a solution flow, comprising:

causing a first fluid and a second fluid to flow into a first mixing channel;

stopping the first fluid and the second fluid in the first mixing channel by keeping both ends of the first mixing channel at the same pressure for at least a threshold amount of time so as to allow the first fluid and the second fluid to mix, thereby forming a first fluid/second fluid mixture;

causing a third fluid to flow into a second mixing channel, the third fluid comprising the first fluid but not including the second fluid, the first and second mixing channels being located on a mixing chip, wherein the mixing chip is separate and in fluid communication with a PCR chip through an interface chip, wherein the PCR chip is configured for performing an amplification reaction;

after holding the first fluid and the second fluid in the first mixing channel for at least the threshold amount of time, drawing, from the first mixing channel, the first fluid/second fluid mixture into a common exit channel located on the mixing chip; and adding DNA samples to the first fluid/second fluid mixture while the first fluid/second fluid mixture is in the interface chip.

29. The method of claim 28, wherein the first fluid and the third fluid are the same fluid.

30. The method of claim 28, wherein the first fluid is a reagent and the third fluid is a buffer solution.

31. The method of claim 28, further comprising:

while holding at least a portion of the first fluid and the second fluid in the first mixing channel, holding the third fluid in the second mixing channel;

while holding at least a portion of the third fluid in the second mixing channel, causing a fourth fluid and a fifth fluid to flow into a third mixing channel;

holding the fourth fluid and the fifth fluid in the third mixing channel for at least a second threshold amount of time so as to allow the fourth fluid and the fifth fluid to mix, thereby forming a fourth fluid/fifth fluid mixture;

after drawing the first fluid/second fluid mixture into the common exit channel, drawing, from the second mixing channel, the third fluid into the common exit channel; and after drawing, from the second mixing channel, the third fluid into the common exit channel, drawing, from the third mixing channel, the fourth fluid/fifth fluid mixture into the common exit channel;

wherein the third fluid separates the first fluid/second fluid mixture from the fourth fluid/fifth fluid mixture within the common exit channel.

* * * * *